US006211661B1

(12) United States Patent
Eckhardt

(10) Patent No.: US 6,211,661 B1
(45) Date of Patent: Apr. 3, 2001

(54) TUNABLE CONSTANT CURRENT SOURCE WITH TEMPERATURE AND POWER SUPPLY COMPENSATION

(75) Inventor: James P. Eckhardt, Pleasant Valley, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/550,009

(22) Filed: Apr. 14, 2000

(51) Int. Cl.[7] ..... G05F 3/20
(52) U.S. Cl. ..... 323/316; 323/314; 323/907
(58) Field of Search ..... 323/312, 313, 323/314, 315, 316, 907

(56) References Cited

U.S. PATENT DOCUMENTS 4,292,583 * 9/1981 Hoeft ..... 323/316
4,714,872 * 12/1987 Traa ..... 323/314

* cited by examiner

*Primary Examiner*—Jessica Han
(74) *Attorney, Agent, or Firm*—Harness, Dickey & Pierce, P.L.C.

(57) ABSTRACT

A tunable constant current source having temperature and power supply compensation is provided. The tunable constant current source includes a voltage regulator, a differential amplifier, a current source and a compensating load. The voltage regulator provides a substantially constant bias voltage $V_B$. The differential amplifier receives the bias voltage $V_B$ and maintains a load voltage $V_L$ substantially equal to the bias voltage $V_B$ by way of a negative feedback. The current source generates a substantially constant current IREF from the differential amplifier. The compensating load varies with temperature changes to maintain the current IREF substantially constant, whereby the tunable constant current source may operate in a supply voltage range between about 0.5 volts to about 1.8 volts.

11 Claims, 4 Drawing Sheets

TUNABLE CONSTANT CURRENT SOURCE WITH TEMPERATURE AND POWER SUPPLY COMPENSATION

BACKGROUND

1. Field of the Invention

This invention relates generally to integrated circuits and, more particularly, to a tunable constant current source with temperature and power supply compensation.

2. Discussion of the Related Art

The generation of a constant current or constant voltage is one of the most critical portions of any analog integrated circuit. Upon generating the constant current or constant voltage source, all other analog circuits are biased off this constant source within the integrated circuit itself. Historically, a constant current source has been supplied by use of a band-gap reference network that is formed by a diode and resistor to generate a constant current source.

While a band-gap reference network works well at conventional supply voltages, such as 5 volts (VCC), as power supply voltages decrease, the band-gap implementation becomes ineffective to inoperative. This is due to the diode drop which is between about 0.7 to 0.8 volts which does not scale and leaves less headroom for current source cascading. In most instances, a band-gap reference network will work well down to a supply voltage of about 2.5 volts and will operate with significant jitter down to about 1.8 volts. However, with new lower voltage power supplies operating in a range of about 1.5 volts, the band-gap reference network is not a viable option. Additionally, the band-gap reference network has undesirable power supply tracking characteristics. These characteristics cause excessive error with respect to power supply noise (delta in output due to delta in power supply).

Since constant current sources are generally used for phase lock loops (PLL) which are generally used to generate clocks for microprocessors, the above disadvantages have drastic effects on microprocessor operation. Moreover, since about 95% of all microprocessors use phase lock loops for generating clock pulses, this effects a broad range of microprocessors operating today. Thus, low power supply microprocessors may not use band-gap reference networks to provide constant current sources. In addition, because of the high sensitivity by band-gap reference networks to power supply changes, this creates jitter in the phase lock loop which adds directly to the cycle time of the processor, thereby reducing the operating speed and efficiency of the microprocessor.

What is needed then is a tunable constant current source with temperature and power supply compensation that does not suffer from the above-mentioned disadvantages. This will, in turn, provide a current source that has a very low sensitivity to power supply changes, provide a low clock skew and jitter in a phase lock loop, thereby reducing cycle time so that the microprocessor may run faster, provide operating supply voltage ranges between about 0.5 volts to about 1.8 volts, provide a constant current within an integrated circuit that can be used for any analog application, such as a phase lock loop which is used for processor clock generation, and provide a constant current source that compensates for temperature variations efficiently. It is, therefore, an object of the present invention to provide such a tunable constant current source with temperature and power supply compensation in an integrated circuit.

SUMMARY OF THE INVENTION

This invention is directed to a constant current source with temperature and power supply compensation which is formed within an integrated circuit. The tunable constant current source basically includes a voltage regulator, a differential amplifier, a current source and a compensating load which all operate to provide a tunable constant current source at low power supply voltage levels.

In one preferred embodiment, a tunable constant current source having temperature and power supply compensation includes a voltage regulator, a differential amplifier, a current source and a compensating load. The voltage regulator provides a substantially constant bias voltage $V_B$. The different amplifier receives the bias voltage $V_B$ and maintains a load voltage $V_L$ substantially equal to the bias voltage $V_B$ by way of a negative feedback. The current source generates a substantially constant current IREF from the differential amplifier. The compensating load varies with temperature changes to maintain the current IREF substantially constant, whereby the tunable constant current source may operate in a supply voltage range between about 0.5 volts to about 1.8 volts.

In another preferred embodiment, a voltage regulator for use in a constant current source includes a negative feedback circuit, a gross temperature compensation circuit, a bias circuit and a temperature compensation circuit. The negative feedback circuit generates a substantially constant bias voltage $V_B$. The gross temperature compensation circuit forms a portion of the negative feedback circuit and has a plurality of decodable branches with one of the plurality of branches selected to operate with the negative feedback circuit based upon an operating temperature of a circuit that employs the voltage regulator. The bias circuit operates to bias the negative feedback circuit with a reference voltage REFP. The temperature compensation circuit varies the reference voltage REFP during slight variations in the operating temperature of the circuit.

Use of the present invention provides a tunable constant current source with temperature and power supply compensation. As a result, the aforementioned disadvantages associated with the current band-gap reference network for use in providing a constant current source have been substantially reduced or eliminated.

DESCRIPTION OF THE DRAWINGS

Still other advantages of the present invention will become apparent to those skilled in the art after reading the following specification and by reference to the drawings in which.

DETAILED DESCRIPTION OF THE INVENTION

The following description of the preferred embodiment concerning a tunable constant current source with temperature and power supply compensation is merely exemplary in nature and is not intended to limit the invention or its application or uses. Moreover, while the present invention is described in detail below with reference to use with particular circuit configurations, such as a phase lock loop (PLL), it will be appreciated by those skilled in the art that the present invention is clearly not limited to use of a tunable constant current source in only a phase lock loop which is merely for exemplary purposes.

Figure 1:
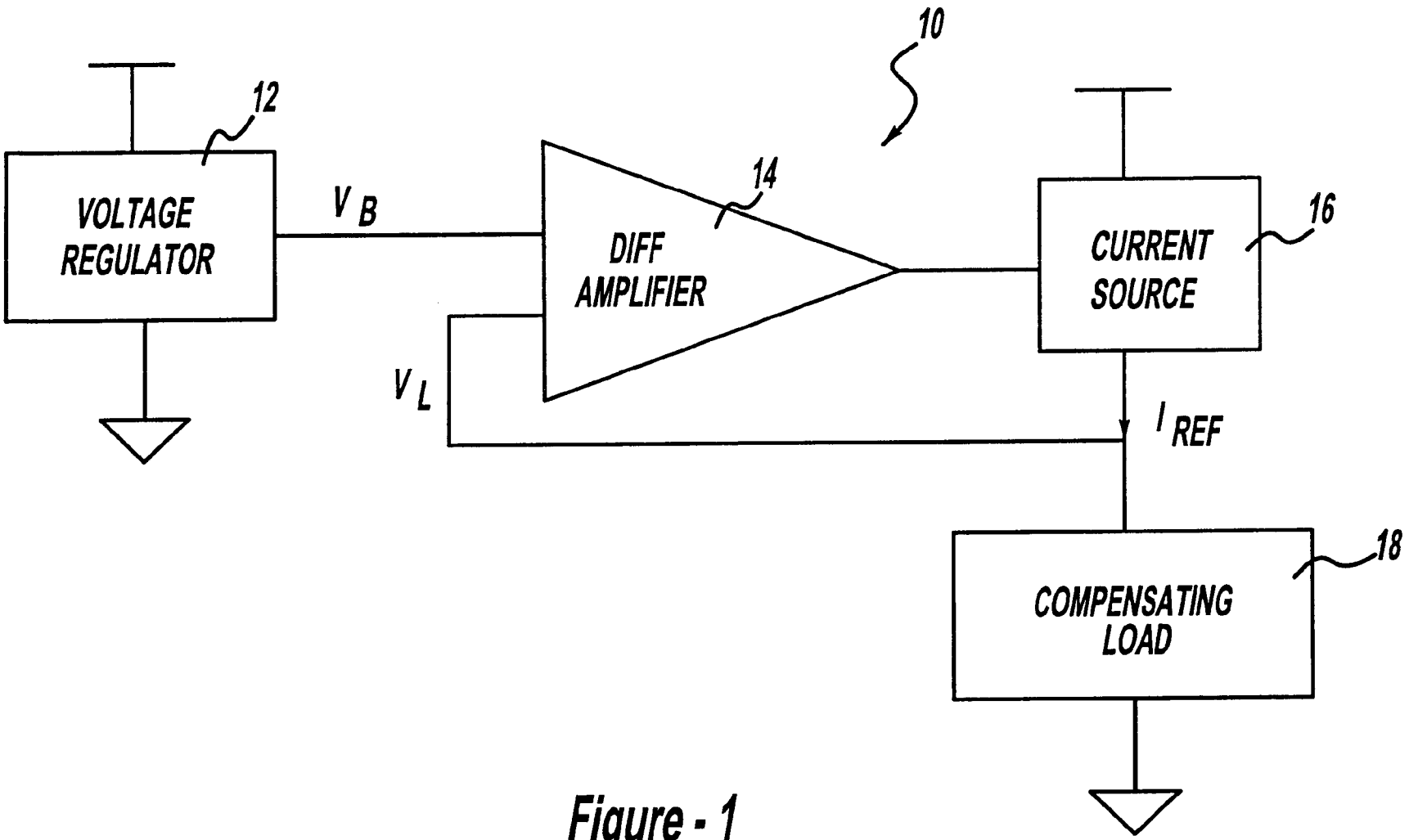
FIG. 1 illustrates a block diagram of a tunable constant current source according to the teachings of the preferred embodiment of the present invention.

Referring to FIG. 1, a tunable constant current source 10 having temperature and power supply compensation according to the teachings of the preferred embodiment of the present invention is shown. The tunable constant current source 10 includes a voltage regulator 12, a differential amplifier 14, a current source 16 and a compensating load 18. The voltage regulator 12 generates a constant bias voltage $V_B$ which is supplied to an input of the differential amplifier 14. The differential amplifier 14 utilizes a negative feedback 20 to hold the load voltage $V_L$ substantially equal to the bias voltage $V_B$ by generating an output voltage supplied to the current source 16. In other words, the differential amplifier 14 biases the current source 16 to generate the current necessary to generate $(I_{REF})(Z_L)=V_L$. Therefore, by holding the load voltage $V_L$ substantially equal to the bias voltage $V_B(V_L=V_B)$, this holds the load voltage $V_L$ constant so that the compensating load 18 is able to sink a constant current $I_{REF}$.

This constant current $I_{REF}$ is used as the output of the tunable constant current source 10 with mirrored versions of this current utilized to feed various analog circuitry in a conventional phase lock loop (PLL) or in other circuits as well. This enables the phase lock loop to act as a supply clock to a microprocessor which operates at a low voltage power supply, such as 1.5 volts. Thus, in order to fix the load voltage $V_L$, the current source 16 must deliver a constant current $(I_{REF})$, such that $(I_{REF})(Z_L)=(V_L)=(V_B)$. The output of the differential amplifier 14 is then fed to as many current mirrors as needed where the mirrored currents will be constant with value (M) $(I_{REF})$, where M is the relative size of the mirrored current source devices with respect to the current source 16 in the negative feedback loop 20 of the differential amplifier 14.

Figure 2:
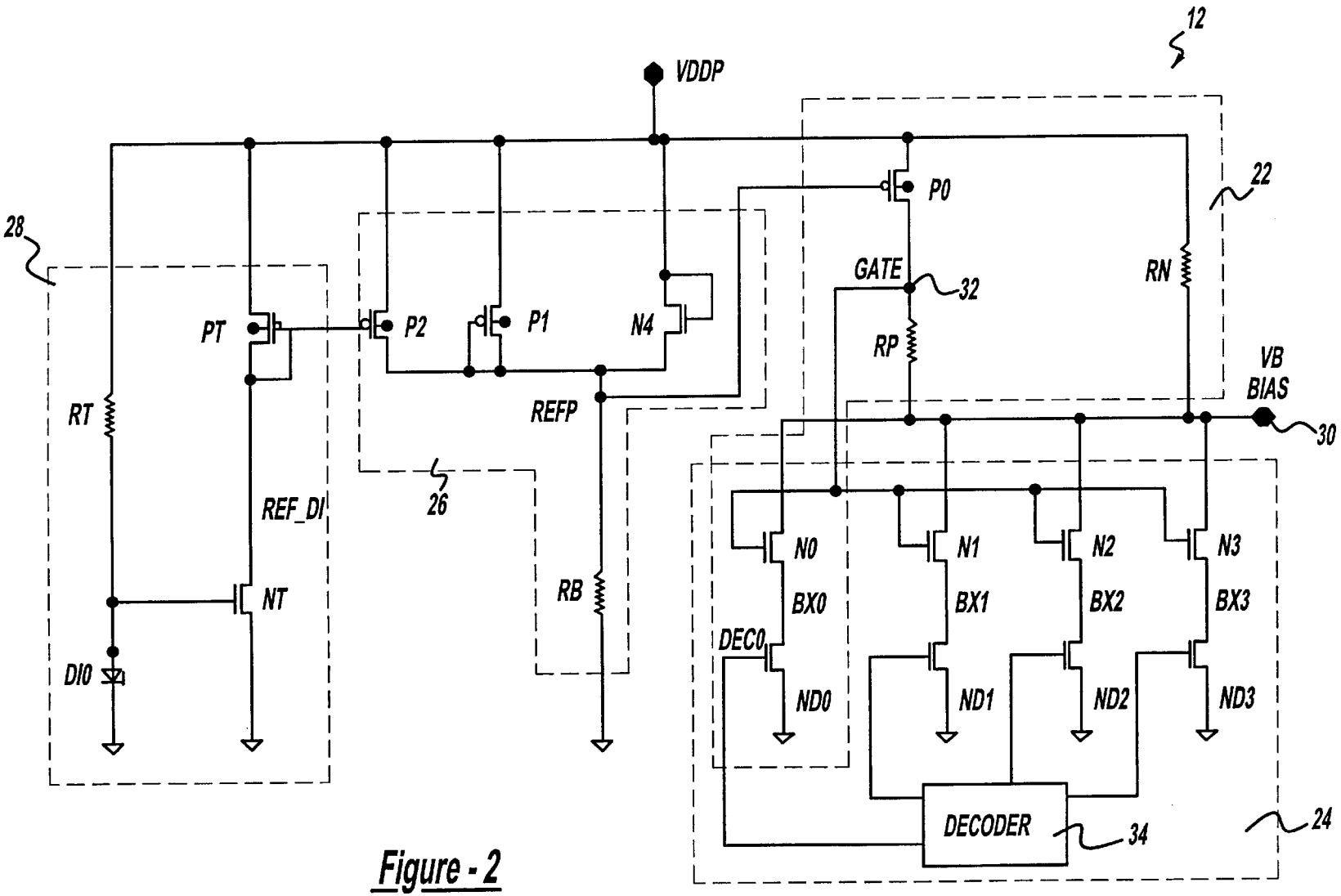
FIG. 2 illustrates a schematic diagram of a voltage regulator of FIG. 1 according to the teachings of the preferred embodiment of the present invention.

Turning to FIG. 2, a schematic diagram of the voltage regulator 12 is shown in further detail. The voltage regulator 12 consists of a negative feedback network 22, a gross temperature compensating circuit 24, a bias/gain circuit 26 and a temperature compensation circuit 28. In general, the voltage regulator 12 uses the negative feedback network 22 to hold the bias node $(V_B)$ 30 constant over changes in VDDP. The scaleable design parameters for the negative feedback network 22 is the ratio of the width of PO divided by the length of RP (WPO/LRP) and the width of NO divided by the length of RN (WNO/LRN), as well as the length of RB relative to the width of P1, P2 and N4 where the longer the length of a resistor, the larger the resistance and the larger the width of a MOSFET, the larger the current transmitted by the MOSFET. The pFETS P1 and P2, the nFET N4 and the resistor RB in the gain/bias circuit 26 are also scalable to provide the correct gain for dREFP/dVDDP. The pFET P0 and the resistor RP are also scalable to give the right amount of VDDP compensation to node GATE 32. Similarly, the sizes of the resistor RN and the nFET N0 are also scalable to provide for the right amount of compensation to node gate 32.

The additional nFETS N1, N2 and N3 in the gross temperature compensation circuit 24 are used to account for a gross shift in process or large changes in operating temperature. Four different nFET sizes are used and decoded orthogonally, such that one nFET is selected for low temperature, another selected for high temperature and another for nominal temperature. The diode DI0, resistor RT, pFET PT and nFET NT in the temperature compensation circuit 28 provide for compensation for small changes in operating temperature, such as ±10° C. In this regard, as temperature increases, the diode voltage across DI0 decreases, thereby decreasing the drain current of nFET NT and the voltage across resistor RT and pFET PT, which reduces the current added to the bias/gain circuit 26.

The voltage regulator 12 is essentially a biased network, such that the bias node $(V_B)$ 30 will stay constant as a function of VDDP, so as VDDP ramps up or down in a DC manner, the bias voltage $V_B$ at bias node 30 will remain unchanged. The negative feedback circuit 22 consists of resistor RN, pFET P0, resistor RP and one of the branches of the gross temperature compensating circuit 24 which is either nFET N0, N1, N2 or N3. The gate 32 of pFET P0 is biased by the feedback network 22 such that a change in VDDP changes the voltage across resistor RP to bias the current through the drain of pFET P0 such that pFET P0 maintains the current feedback characterization through the feedback network 22. In other words, as VDDP is ramped up or down, the bias node $(V_B)$ 30 will stay substantially constant or have an umbrella shape (see FIG. 5) with a low sensitivity to supply voltage changes. This negative feedback at the gate node 32 biases the nFET N0, N1, N2 or N3 whichever is selected via the decoder 34. In this way, as current changes in P0, this changes current through RP thereby changing the gate voltage at gate node 32 which feeds back to the gate of N0, assuming this branch is currently operating, to change the current across resistor RN to control the bias voltage $V_B$ at bias node 30.

For example, assuming that the nFET N0 branch of the gross temperature compensating circuit 24 is employed, maintenance of the constant bias voltage $V_B$ is provided by way of two inverters. These inverters consist of nFET N0 and resistor R1 and pFET P0 with resistor RP. As the power supply VDDP changes, there will be a change in the voltage REFP that has a relationship of 8 to 1 so that you do not have a 1 to 1 change in REFP to VDDP. This ratio is provided by the bias/gain circuit 26. The voltage at REFP will thus change based upon changes in VDDP, such that the voltage across resistor RP and accordingly the voltage at gate node 32 will change as VDDP changes. This change in gate voltage at gate node 32 will change the gate voltage in nFET N0 which will change the current through resistor RN to control the bias voltage $V_B$ at bias node 30. Thus, the negative feedback or circuit 22 will generate a change in current across resistor RN such that as the gate voltage at gate node 32 goes up, voltage at the gate of nFET N0 goes up to create more current through resistor RN, thereby pulling the bias voltage $V_B$ at bias node 30 down while also pulling the voltage at the gate node 32 down, via this negative feedback. In other words, in the negative feedback system 22, as the gate voltage at gate node 32 changes, this changes the voltage at the gate of nFET N0, thus increasing or decreasing its current to change the voltage across resistor RN which is providing a negative feedback return to gate node 32 to hold the bias voltage $V_B$ constant. It should further be noted that this negative feedback network or circuit 22 is very scalable or tunable by simply changing the nFET N0 and pFET P0 combination to get a new bias voltage $V_B$ at a new desired value.

Referring to the gross temperature compensation circuit 24, this circuit consists of four individual branches with each branch including a pair of nFET transistors in series with one nFET transistor in each branch in communication with the decoder 34. The decoder 34 enables which branch in the temperature compensation circuit 24 that will be used in combination with the negative feedback network 22. In this regard, the nFET N0 branch is for operation at nominal temperatures of about 0° C. The nFET N1 branch is directed to high operating temperatures of about 80° C. The nFET N2 branch is directed to low operating temperatures of about −50° C. The nFET N3 branch is directed to high operating temperatures utilizing worst case hardware. Accordingly, based upon the operating condition of the particular circuit or the hardware utilized, the decoder 34 will merely be configured to select the appropriate branch for operation in combination with the negative feedback network circuit 22.

The bias/gain circuit 26 utilizes resistor $R_B$, nFET N4, and pFETS P1 and P2 to set up the proper voltage divider to provide a correct bias at REFP for the pFET P0. The temperature compensating circuit 28 is used for maintaining a constant bias voltage $V_B$ through small temperature changes of about ±10° C. The temperature compensation circuit 28 utilizes the diode DI0 and the nFET NT to control temperature compensation for the bias voltage at REFP to provide a broader operating window over slight temperature ranges.

Figure 3:
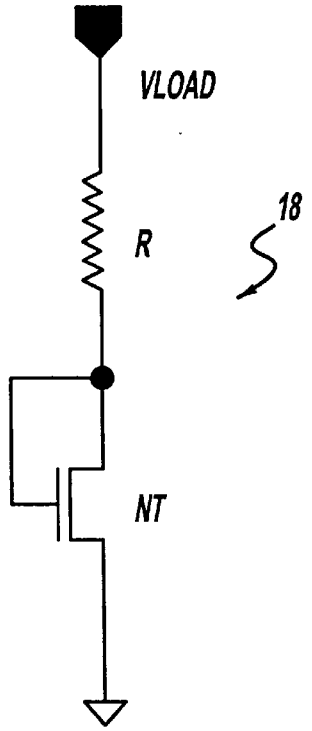
FIG. 3 illustrates a schematic diagram of a compensating load of FIG. 1 according to the teachings of the preferred embodiment of the present invention.

Turning to FIG. 3, the compensating load 18 is shown in further detail. The compensating load 18 consists of a very large nFET transistor NT and a resistor R in series. Since the resistor value for resistor R will vary slightly with variations in temperature change, this will create a change in $I_{REF}$. By adding the nFET NT in series, the nFET NT threshold voltage will move in the opposite direction of the resistor current. Therefore, as temperature goes up, the current through the resistor R will go down, but the threshold voltage of nFET NT will also go down, and as a result, there will be a large voltage across resistor R to compensate for the change in the temperature. This reduces the current through the resistor R, but increases the voltage across the resistor R, thus compensating for temperature changes to provide for a stabile $I_{REF}$. The compensating load 18 is preferably configured to operate between about −50° C. to about +80° C.

Figure 4:
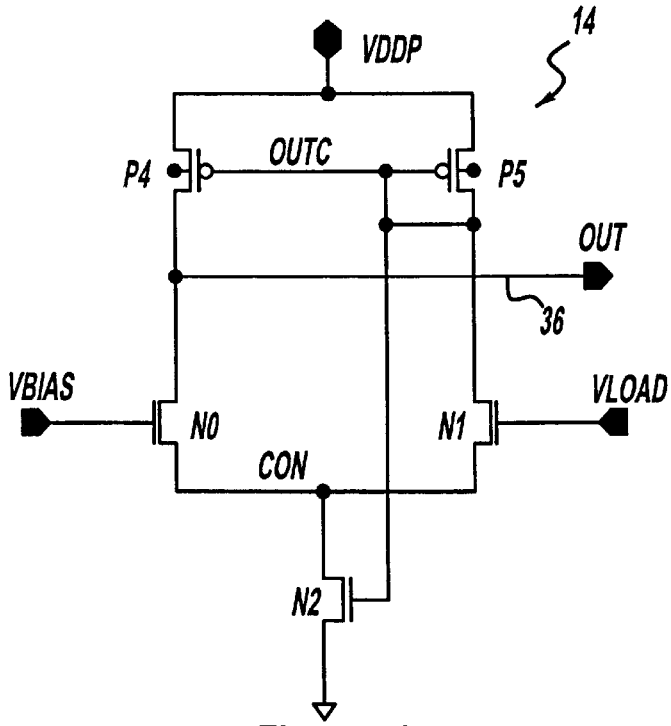
FIG. 4 illustrates a schematic diagram of a differential amplifier of FIG. 1 according to the teachings of the preferred embodiment of the present invention.

Turning now to FIG. 4, a schematic diagram of the differential amplifier 14 is shown in further detail. The differential amplifier 14 is a standard and conventional differential amplifier. In this regard, nFET N2 acts as a current source, while nFET N0 and nFET N1 steer the current between pFET P4 and pFET P5. Thus, if V bias ($V_B$) is greater than V load ($V_L$), current is steered through nFET N0 and pFET P4 so that there is a voltage drop at output 36. If V load ($V_L$) is greater than V bias ($V_B$), current is steered through nFET N1 and pFET P5, such that voltage goes up at output 36. nFET N2 is also biased by both pFET P4 and pFET P5 such that if V bias ($V_B$) is greater than V load ($V_L$), this turns nFET N2 off slightly to further increase or decrease the output swing, thereby increasing the gain of the overall differential amplifier 14.

The current source 16 is a standard cascaded current source which can consist of either two p-channel MOSFETS in series or one p-channel MOSFET. The MOSFET is then biased with the output voltage of the differential amplifier 14 at its gate with the source being VDDP and the drain being $V_L$.

Figure 5:
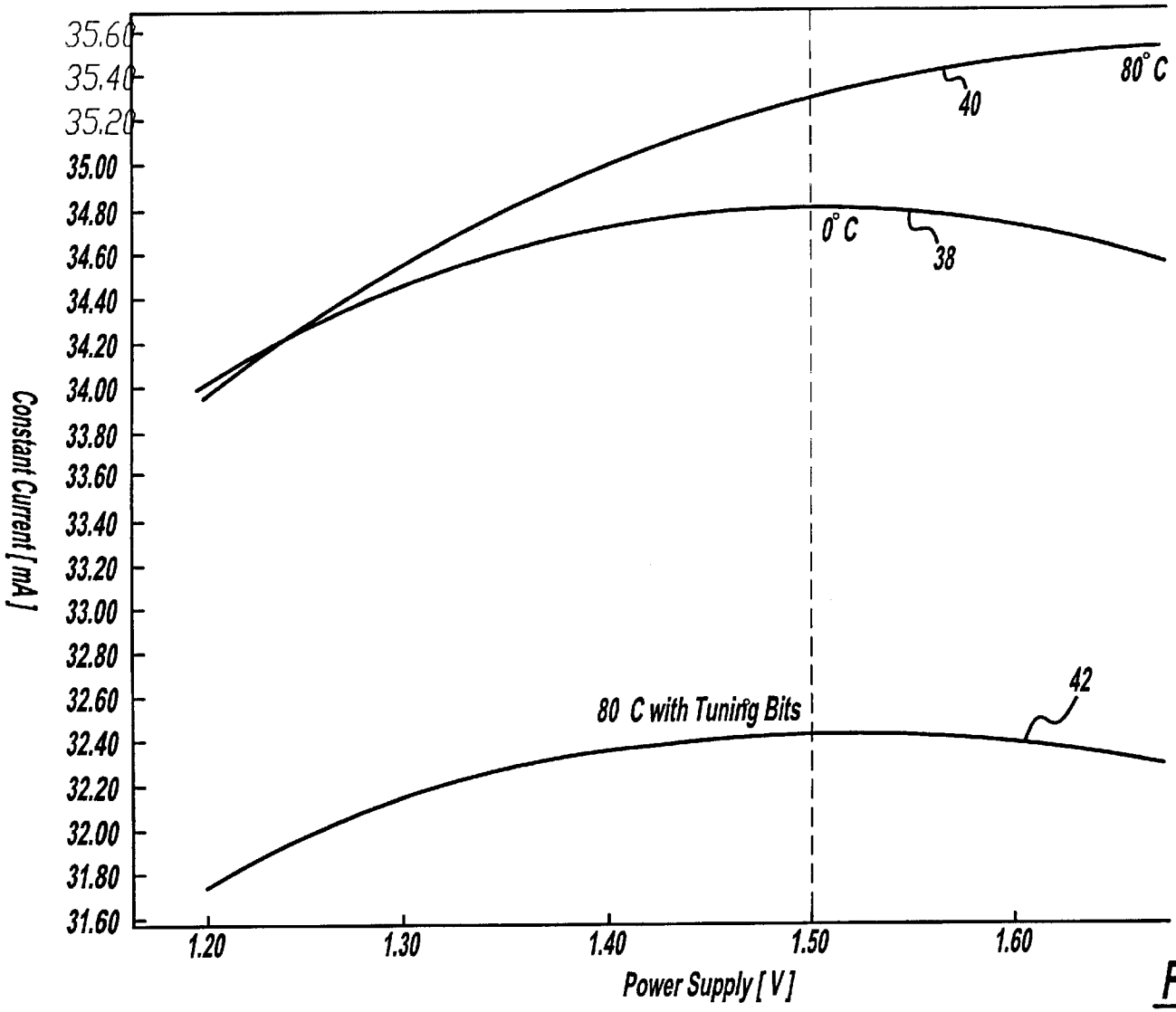
FIG. 5 is a graph illustrating the constant current response versus power supply voltage of the tunable constant current source according to the teachings of the preferred embodiment of the present invention.

Referring now to FIG. 5, the responsiveness of the constant current source 10 is shown. In this regard, the X axis illustrates the change in power supply while the Y axis illustrates the change in current (mA). Referring to response 38, this illustrates a response of the constant current source 10 when the nFET N0 is used in the voltage regulator 12. In this regard, the response 38 is centered substantially about the 1.5 volt area so that the response or curve 38 is substantially flat in this region. Thus, any slight fluctuations in the power supply, from the supply voltage of 1.5 volt, will provide substantially the same current output.

Assuming the constant current source 10 is operating with the voltage regulator utilizing the nFET N0 at 80° C., the response 40 will now be observed. This shows that the response shifts off-center such that with any slight change in power supply voltage from 1.5 volt, there is also a change in the current which is an undesirable effect. Therefore, by providing the tuning bits or various branches in the gross temperature compensating circuit 24, upon adjusting for the high temperature branch or nFET N1, the response now shifts to a lower current, but with the response 42 being centered substantially along the 1.5 volt power supply. In this way, any change again in power supply voltage will essentially provide a constant current. It should further be noted that a reduction in current supply between response 40 and 42 does not pose a problem for a phase lock loop or other analog circuitry since the main criteria is that the source provide a constant current with variations in power supply voltage.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A tunable constant current source having temperature and power supply compensation, said tunable constant current source comprising:

a voltage regulator operable to provide a substantially constant bias voltage $V_b$, said voltage regulator includes a gross temperature compensation circuit operable to switch between one of a plurality of branches depending upon an operating temperature of a circuit employing said tunable constant current source to maintain said bias voltage $V_B$ substantially constant;

a differential amplifier operable to receive said bias voltage $V_B$ and maintain a load voltage $V_L$ substantially equal to said bias voltage $V_B$ by way of a negative feedback;

a current source operable to generate a substantially constant current IREF from said differential amplifier; and a compensating load operable to vary with temperature changes to maintain said current IREF substantially constant, wherein said tunable constant current source may operate in a supply voltage range between about 0.5 volts to about 1.8 volts.

2. The tunable constant current source as defined in claim 1 wherein said voltage regulator includes a negative feedback network operable to maintain said bias voltage $V_B$ substantially constant.

3. The tunable constant current source as defined in claim 1 wherein said voltage regulator further comprises a temperature compensating circuit operable to maintain said bias voltage $V_B$ substantially constant through slight fluctuations in temperature of between about ±10° C.

4. The tunable constant current source as defined in claim 1 wherein said compensating load includes a resistor in series with a MOSFET transistor.

5. The tunable constant current source as defined in claim 4 whereby as an operating temperature increases, current through said resistor decreases while a voltage across said resistor increases via said MOSFET, thereby compensating for said increase in temperature change.

6. A voltage regulator for use in a constant current source, said voltage regulator comprising:

a negative feedback circuit operable to generate a substantially constant bias voltage $V_B$;

a gross temperature compensation circuit forming a portion of said negative feedback circuit and having a plurality of decodable branches with one of said plurality of branches selected to operate with said negative feedback circuit based upon an operating temperature of a circuit employing said voltage regulator;

a bias circuit operable to bias said negative feedback circuit with a reference voltage REFP; and a temperature compensation circuit operable to vary said reference voltage REFP during slight variations in said operating temperature of said circuit.

7. The voltage regulator as defined in claim 6 wherein said negative feedback circuit includes a pair of inverters with each inverter including a MOSFET and a resistor.

8. The voltage regulator as defined in claim 7 wherein each of said plurality of branches in said gross temperature compensation circuit includes a pair of MOSFETS in series with one of said MOSFETS in each branch in communication with a decoder.

9. The voltage regulator as defined in claim 8 wherein one of said MOSFETS in each of said plurality of branches forms a portion of one of said inverters in said negative feedback circuit.

10. The voltage regulator as defined in claim 6 wherein said temperature compensation circuit includes a diode in communication with a gate of a MOSFET, whereby as said operating temperature increases, a diode voltage decreases, thereby decreasing a drain current of said MOSFET, to reduce said reference voltage REFP of said bias circuit.

11. The voltage regulator as defined in claim 6 wherein said plurality of branches in said gross temperature compensation circuit includes a first branch for operating at a nominal temperature of about 0° C., a second branch for operating at a high temperature of about 80° C. and a third branch for operating at a low temperature of about −50° C.

* * * * *